US009010496B2

(12) United States Patent
Johansson et al.

(10) Patent No.: US 9,010,496 B2
(45) Date of Patent: Apr. 21, 2015

(54) METHOD TO INCREASE THE HEAD ROPE LIFE FOR SINGLE CONVEYANCE FRICTION MINE HOISTS FOR DEEP SHAFTS

(75) Inventors: Borje Johansson, Vasteras (SE); Sigurd Grimestad, Vasteras (SE)

(73) Assignee: ABB AB (SE)

( * ) Notice: Subject to any disclaimer, the term of this patent is extended or adjusted under 35 U.S.C. 154(b) by 1013 days.

(21) Appl. No.: 12/126,696

(22) Filed: May 23, 2008

(65) Prior Publication Data

US 2008/0223664 A1 Sep. 18, 2008

Related U.S. Application Data

(63) Continuation of application No. PCT/SE2006/050500, filed on Nov. 22, 2006.

(60) Provisional application No. 60/739,494, filed on Nov. 25, 2005.

(51) Int. Cl.

| | |
|---|---|
| ***B66B 7/06*** | (2006.01) |
| ***B66B 7/10*** | (2006.01) |
| ***B66B 19/00*** | (2006.01) |

(52) U.S. Cl.

CPC . *B66B 7/068* (2013.01); *B66B 7/06* (2013.01); *B66B 19/007* (2013.01)

(58) Field of Classification Search

CPC ..... B66B 7/06; B66B 7/068; B66B 7/10; B66B 19/00; B66B 19/007

USPC ..... 187/251, 254, 256, 264, 404; 254/265, 254/266, 278, 283, 293

See application file for complete search history.

(56) References Cited

U.S. PATENT DOCUMENTS

| | | | | | |
|---|---|---|---|---|---|
| 1,132,769 | A * | 3/1915 | Gale, Sr. | 187/264 |
| 1,625,083 | A * | 4/1927 | Hymans | 294/82.1 |
| 1,837,643 | A * | 12/1931 | Anderson | 187/249 |
| 3,882,968 | A * | 5/1975 | Suozzo | 187/264 |
| 5,566,783 | A * | 10/1996 | Yamashita | 187/210 |
| 5,788,018 | A * | 8/1998 | Mendelsohn et al. | 187/404 |
| 6,364,063 | B1 * | 4/2002 | Aulanko et al. | 187/266 |
| 2003/0155185 | A1 * | 8/2003 | Nomura et al. | 187/266 |

FOREIGN PATENT DOCUMENTS

| | | |
|---|---|---|
| DE | 677555 C1 | 6/1939 |
| DE | 692304 C1 | 6/1940 |
| DE | 1153141 B1 | 8/1963 |

(Continued)

OTHER PUBLICATIONS

Lubomir Janovsky, Elevator Mechanical Design Principles and Concepts, 1987, Ellis Horwood Limited, p. 98-99.*

(Continued)

*Primary Examiner* — William A Rivera
*Assistant Examiner* — Stefan Kruer
(74) *Attorney, Agent, or Firm* — St. Onge Steward Johnston & Reens LLC

(57) ABSTRACT

The invention relates to a device and system for underground transport of ore, material and people, which includes electrical and mechanical drive systems, a plurality of hoisting devices, head ropes and balance ropes. The mass per meter of the balance ropes is significantly smaller than the mass per meter of the head ropes.

7 Claims, 5 Drawing Sheets

(56) References Cited

FOREIGN PATENT DOCUMENTS

| | | | |
|---|---|---|---|
| DE | 1161399 | B1 | 1/1964 |
| EP | 1445229 | A1 | 8/2004 |
| GB | 113081 | A2 | 2/1918 |
| WO | WO 2004094287 | A2 * | 11/2004 ..... B66B 11/08 |

OTHER PUBLICATIONS

European Search Report Application No. EP 06 82 4569 Completed: Mar. 21, 2013; Mailing Date: Mar. 28, 2013 5 pages.

* cited by examiner

METHOD TO INCREASE THE HEAD ROPE LIFE FOR SINGLE CONVEYANCE FRICTION MINE HOISTS FOR DEEP SHAFTS

CROSS-REFERENCE TO RELATED APPLICATIONS

The present application is a continuation of pending International patent application PCT/SE2006/050500 filed on Nov. 22, 2006 which designates the United States and claims benefit under 35 U.S.C. §119 (e) of the U.S. Provisional Patent Application Ser. No. 60/739,494 filed on Nov. 25, 2005. All prior applications are herein incorporated by reference in their entirety.

FIELD OF THE INVENTION

The present invention concerns a method and device to increase the head rope life for single conveyance friction hoists for deep shafts.

BACKGROUND OF THE INVENTION

A friction mine hoist, which may be of the double or of the single conveyance type, may be characterized by a pulley with friction liners, or similar, grooved to the diameter of the head ropes. The conveyances (skip or cage) for a double friction hoist are carried by the head rope(s) with the head ropes laid over the pulley with a contact angle of about 180 degrees. The rope ends are secured to the conveyances. The friction between the head rope(s) and the friction liners allows for a certain difference in rope tension of the two sides of the pulley without the occurrence of rope slip. Balance/Tail rope(s) are attached under the conveyances to limit reduce the difference in rope tension between the two sides of the pulley. Traditionally the mass per meter of the balance ropes has been dimensioned to be equal or nearly equal to the mass per meter of the head ropes. Thereby the safety margin before rope slip occurs is independent or nearly independent of the position in the shaft of the two conveyances.

A single friction hoist is based on the same principle as a double friction hoist, but with the difference that one of the conveyances is replaced by a counterweight. The mass of the counterweight is normally selected to be equal to the conveyance mass plus 50% of the net load. Thereby the difference in rope tension between the two sides of the pulley at empty conveyance and at normal net load will be the same. Friction mine hoists can be ground mounted with head sheaves in the head frame or tower mounted with or without deflection sheaves.

The static load variations in the head ropes occur as a result of loading the conveyance at the lower stop level and then hoisting it to the unloading (dumping) level at the upper end of the shaft whereby the balance rope(s) add mass to the ascending conveyance side, so adding rope tension in the head rope(s). The load variations can either be expressed as differences in tension (MPa or psi) or as load variations in percent of the breaking load of the head rope(s).

The life of the head ropes of a mine hoist of the friction hoist type depends on several factors such as:

- load distribution between the ropes in case of multi-rope arrangement
- diameter ratio between the pulley and the ropes and between deflection sheaves or head sheaves and the ropes
- the rope construction and wire tensile strength
- the breaking strength of the rope
- rope oscillations at loading and dumping (release) of the load
- longitudinal and transverse rope oscillations
- quasi stationary loads under acceleration and retardation
- static load variations in particular near the rope ends (Static Load Range)

Acceptable rope life is normally obtained for friction hoists in installations with hoisting distances up to 1400 to 1500 m by adopting applicable mine hoist regulations and good engineering practice.

At hoisting distances in excess of 1400 to 1500 m using friction hoists, the Static Load Range (SLR) increases to be the dominating factor determining the head rope life. Thereby, the SLR i.e. the maximum static load variation at the rope ends in percent of the rope breaking strength determines the limit for the practical/economical maximum hoisting distance for friction hoists. The SLR can be expressed by using the following equation:

$$SLR\ (\%)=(Nl+(z2*q2*H))*g*100/(z1*B)\ \text{where}$$

Nl=Net load (kg)
z2=the number of balance ropes
q2=the mass per meter of the balance ropes (kg/m)
H=the hoisting distance (m)
g=9.81 (m/s2)
z1=the number of head ropes
B=the breaking strength for the head ropes (N)

SUMMARY OF THE INVENTION

The load variation caused by the mass of the balance ropes is dominating in friction hoists over large hoisting distances. The technical solution for reducing the static load variations for single conveyance friction hoists is to reduce the mass per meter of the balance ropes instead of the traditional practice to keep the mass equal or close to the mass per meter of the head ropes.

An embodiment of the present invention provides an improvement to considerably reduce the Static Load Range (SLR) while maintaining required margin before rope slip. Thereby the hoisting distance and/or the net loads can be significantly increased, and the lifetime for the head ropes can be significantly increased. Alternative solutions for single conveyance friction hoists are not known.

BRIEF DESCRIPTION OF THE DRAWINGS

Embodiments of the invention will now be described, byway of example only, with particular reference to the accompanying drawings in which.

DETAILED DESCRIPTION OF THE INVENTION

The following example illustrates the advantage of the solution of the invention:

Good engineering practice is to limit the SLR to at least 11.5% of the breaking strength of the head ropes. Taking this value as criteria for acceptable load variation illustrates the advantage of the solution:

Head ropes: 4×56 $mm^2$ of certain construction and breaking load

Static Load Range: 11.5%

Conveyance mass: Equal to the net load

| Hoisting distance (m) | Possible net load (kg) | |
|---|---|---|
| | Rope balance | Balance rope mass as per the invention |
| 1 700 | 28 538 | 57 764 |
| 1 800 | 22 776 | 45 275 |
| 1 900 | 17 018 | 33 583 |
| 2 000 | 11 259 | 22 129 |

Balance ropes are also known as tail ropes.

| Hoisting distance (m) | Required rope safety factor | |
|---|---|---|
| | Rope balance | Balance rope mass as per the invention |
| 1 700 | 6.99 | 5.15 |
| 1 800 | 7.26 | 5.60 |
| 1 900 | 7.54 | 6.15 |
| 2 000 | 7.85 | 6.80 |

Head ropes and conveyance mass as above

| Hoisting distance (m) | Rope safety factor | SLR (%) | |
|---|---|---|---|
| | | Rope balance | Balance rope mass as per the invention |
| 1500 | 6.0 | 12.17 | 10.01 |
| 1600 | 6.0 | 12.43 | 10.41 |
| 1700 | 6.0 | 12.70 | 10.80 |
| 1800 | 6.0 | 12.96 | 11.19 |
| 1900 | 6.5 | 12.57 | 11.26 |
| 2000 | 7.0 | 12.28 | 11.38 |

Figure 1:
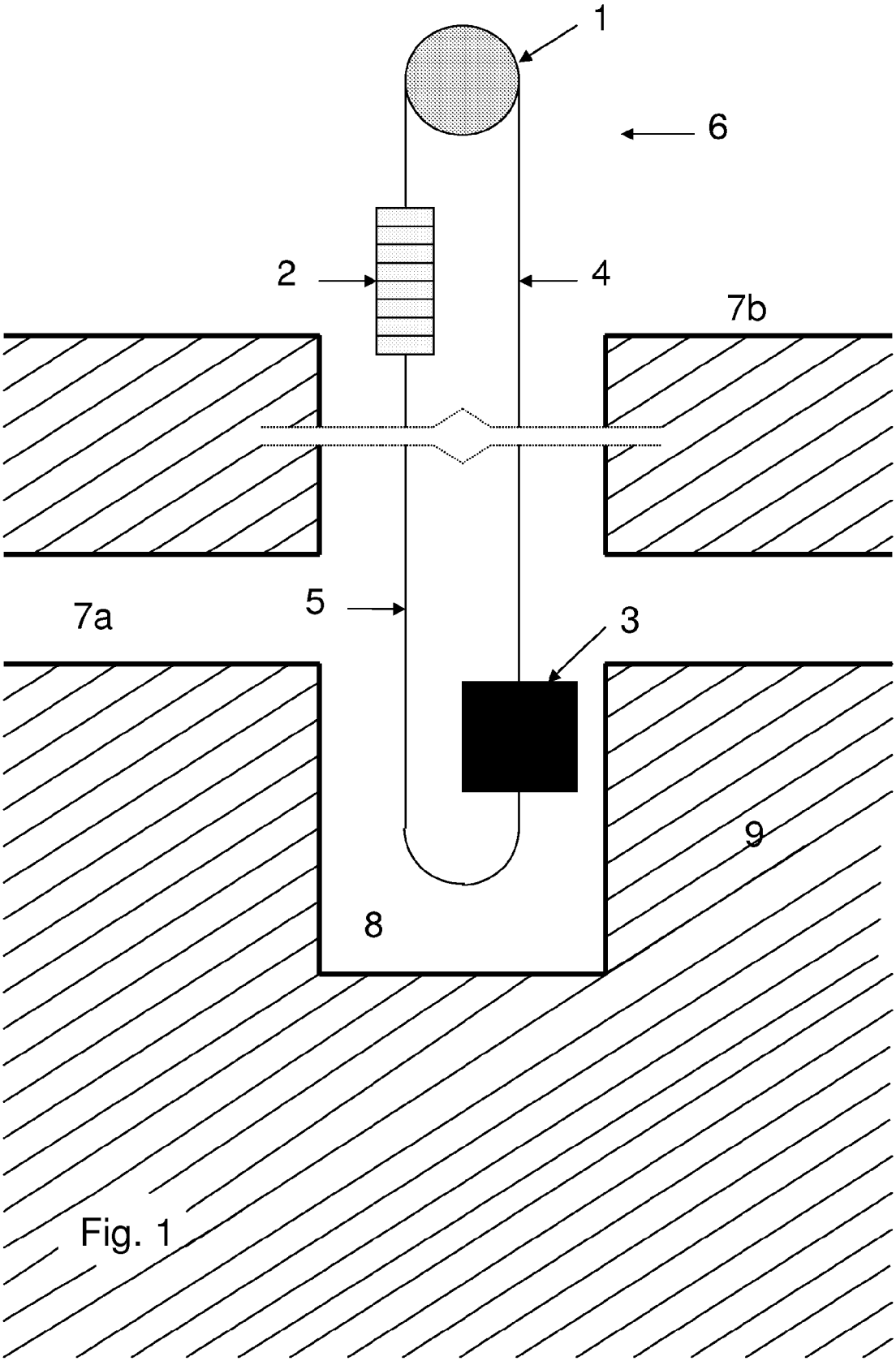
FIG. 1 shows a simplified diagram of a system comprising a friction mine hoist according to an embodiment of the invention.
Figure 2:
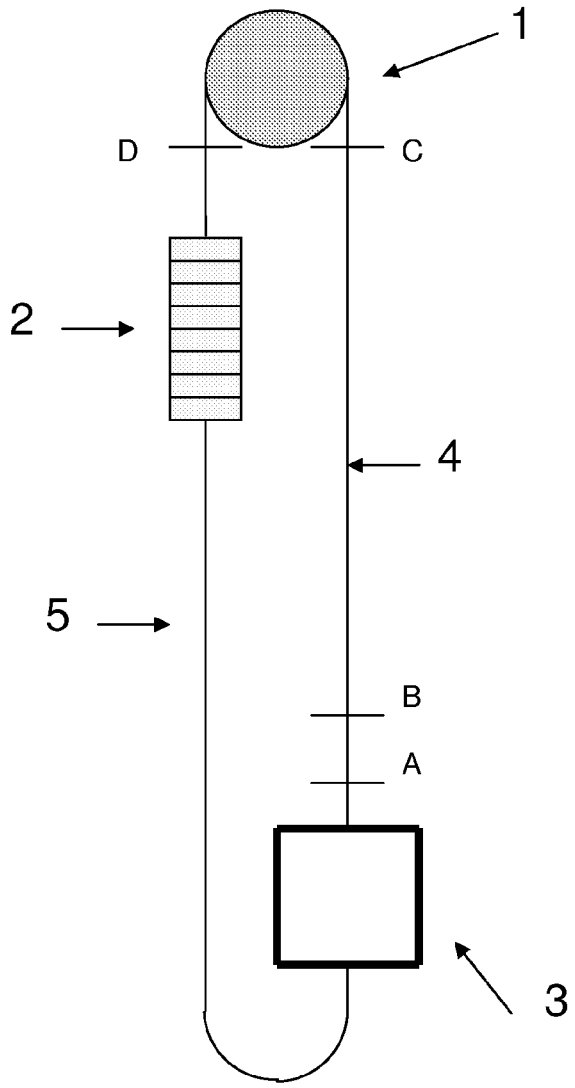
FIG. 2 shows a simplified diagram of a system comprising a friction mine hoist with an empty conveyance in the lowest position.
Figure 3:
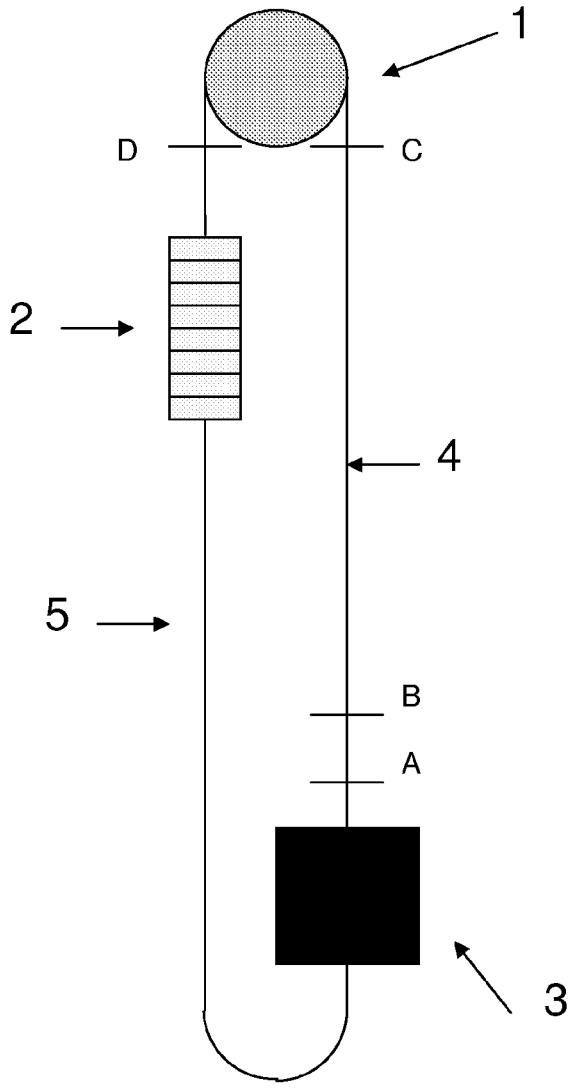
FIG. 3 shows a simplified diagram of a system comprising a friction mine hoist with a loaded conveyance in the lowest position.
Figure 4:
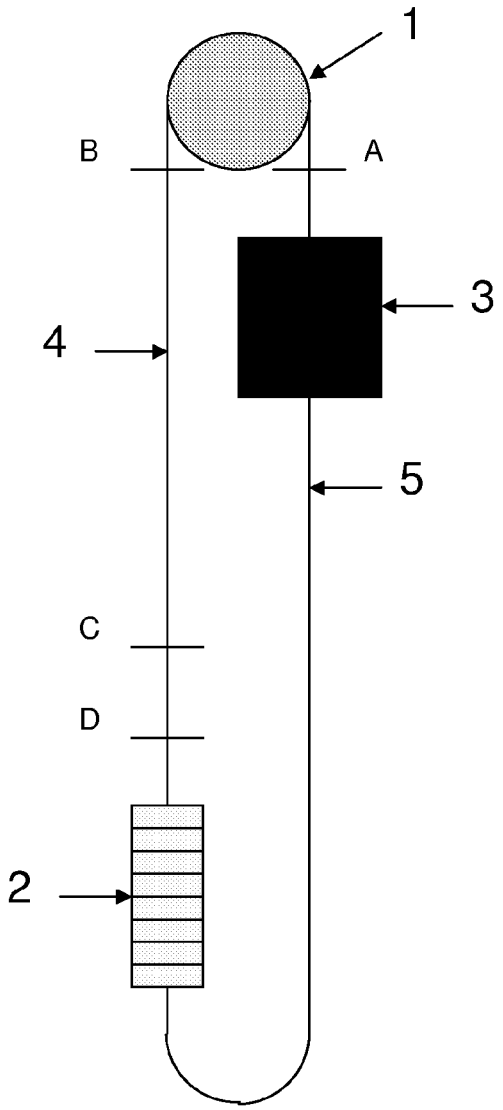
FIG. 4 shows a simplified diagram of a system comprising a friction mine hoist with a loaded conveyance in the highest position.
Figure 5:
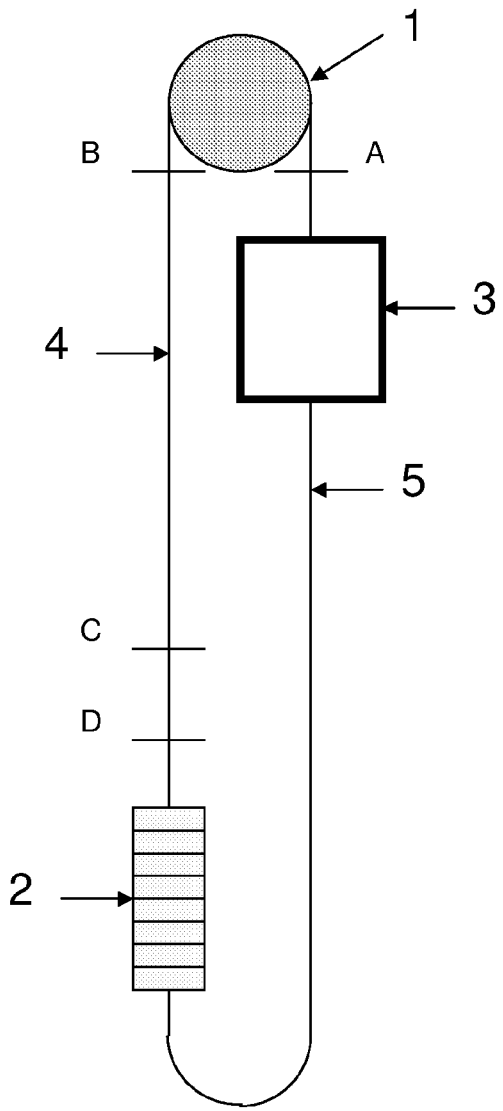
FIG. 5 shows a simplified diagram of a system comprising a friction mine hoist with an empty conveyance in the highest position.

FIG. 1 shows a friction mine hoist (6) in a deep shaft (8) in the ground (9), the shaft having at least two levels (7*a*, 7*b*) for loading and unloading of ore, materials and personnel, the hoist comprising a pulley (1), a counterweight (2), a conveyance (3), head ropes (4) and balance ropes (5).

The static rope tension acting on the head ropes, may for example be calculated at 4 critical points (A, B, C and D), and at four different times (t1, t2, t3, and t4) which depend on the position of the conveyance and if the conveyance is unloaded or loaded, according to the following equations:

FIG. 2:

When t=t1 (unloaded conveyance in lowest position)

At point *A*: $F=Sk*g$

At point *B*: $F=Sk*g$

At point *C*: $F=(Sk+Lv1)*g$

At point *D*: $F=(Mv+Lv2)*g$ where

F=the calculated static rope tension (N)

Sk=Conveyance mass (kg)

g=9.81 m/s2

Mv=Counterweight mass (=Sk+0.5*Nl) where Nl=Net load (kg)

Lv1=the total mass of the head ropes (kg)

Lv2=the total mass of the balance ropes (kg)

Due to the large hoisting distance the mass of the upper and bottom part of the rope loops, as well as the rope mass between the points A and B, can be neglected.

FIG. 3:

When t=t2 (loaded conveyance in lowest position)

At point *A*: $F=(Sk+Nl)*g$

At point *B*: $F=(Sk+Nl)*g$

At point *C*: $F=(Sk+Nl+Lv1)*g$

At point *D*: $F=(Mv+Lv2)*g$ where

Nl=Net load (kg)

Mv=Counterweight mass (kg)

Other definitions as described above at t1.

Due to the large hoisting distance the mass of the upper and bottom part of the rope loops, as well as the rope mass between the points A and B, can be neglected.

FIG. 4:

When t=t3 (loaded conveyance in highest position)

At point *A*: $F=(Sk+Nl+Lv2)*g$

At point *B*: $F=(Mv+Lv1)*g$

At point *C*: $F=Mv*g$

At point *D*: $F=Mv*g$

Definitions as described above at t1 and t2.

Due to the large hoisting distance the mass of the upper and bottom part of the rope loops, as well as the rope mass between the points C and D, can be neglected.

FIG. 5:

When t=t4 (unloaded conveyance in highest position)

At point *A*: $F=(Sk+Lv2)*g$

At point *B*: $F=(Mv+Lv1)*g$

At point *C*: $F=Mv*g$

At point *D*: $F=Mv*g$

Definitions as described above at t1 and t2.

Due to the large hoisting distance the mass of the upper and bottom part of the rope loops, as well as the rope mass between the points C and D, can be neglected.

According to the equations mentioned above the load tension variations in critical points (A, B, C and D) can be calculated according to the following equations:

Point *A*: $(Sk+Nl+Lv2)*g-Sk*g=(Nl+Lv2)*g$

Point *B*: $(Mv+Lv1)*g-Sk*g=(Sk+0.5*Nl+Lv1-Sk)*g=(Lv1+0.5*Nl)*g$

Point *C*: $(Sk+Nl+Lv1)*g-Mv*g=(Sk+Nl+Lv1-Sk-0.5*Nl)*g=(Lv1+0.5*Nl)*g$

Point *D*: $(Mv+Lv2)*g-Mv*g=Lv2*g$

Minimum rope tension variation appears when the variation in point

A is equal to variation in point B, thus $(Nl+Lv2)*g=(Lv1+0.5*Nl)*g=>Lv2=Lv1-0.5*Nl$ this will give the following variations:

Point *A*: $(Nl+Lv1-0.5*Nl)*g=(Lv1+0.5*Nl)*g$

Point *B*: $(Lv1+0.5*Nl)*g$

Point $C$: $(Lv1+0.5*Nl)*g$

Point $D$: $Lv2*g=(Lv1-0.5*Nl)*g$

The optimum balance rope mass per meter is calculated with the following equation:

$$q2=(z1*q1*H-0.5*N1)/(z2*H)$$

where q2 is the mass per meter of the balance rope (kg/m)

z1 is the number of head ropes q1 is the mass per meter of the head rope (kg/m)

H is the hoisting distance (m)

z2 is the number of balance ropes

At optimum balance rope mass the SLR is reduced by the value defined by the following equation:

$$\Delta SLR\ (\%)=0.5*Nl*g*100/(z1*B)$$

It should be noted that while the above describes exemplifying embodiments of the invention, there are several variations and modifications which may be made to the disclosed solution without departing from the scope of the present invention as defined in the appended claims.

What is claimed is:

1. A hoisting device for underground transport comprising:

a driving pulley for providing a driving force;

a counterweight having a top and a bottom;

a conveyance having a top and a bottom;

at least one head rope laid over said driving pulley for transferring the driving force to raise and lower said conveyance over a hoisting distance, said at least one head rope having a first end, a second end, and a mass per meter, wherein the first end of said at least one head rope is attached to the top of said conveyance and the second end of said at least one head rope is attached to the top of said counterweight;

at least one passive balance rope having a first end, a second end, and a mass per meter, wherein the first end of said at least one balance rope is attached to the bottom of said conveyance and the second end of said at least one balance rope is attached to the bottom of said counterweight; and the mass per meter of said at least one balance rope is smaller than the mass per meter of said at least one head rope, the mass per meter of said at least one balance rope determined employing the following equation:

$$q2=(z1*q1*H-0.5*Nl)/(z2*H)$$

where:

q1=the mass per meter of said at least one head rope (kg/m), q2=the mass per meter of said at least one balance rope (kg/m), z1=number of said at least one head rope, z2=number of said at least one balance rope, H=the hoisting distance (m), the hoisting distance being greater than 1400 meters, Nl=net load of the conveyance (kg).

2. The device according to claim 1, wherein the hoisting distance is greater than 1500 meters.

3. A hoisting device for underground transport comprising:

a driving pulley;

at least one head rope laid over said driving pulley for transferring a driving force, said at least one head rope having a first end, a second end, and a mass per meter, a conveyance for transporting a net load over a hoisting distance, said conveyance suspended from the first end of said head rope;

a counterweight suspended from the second end of said head rope, said counterweight having a weight of about:

$$Mv=Sk+0.5*Nl$$

where:

Mv=Counterweight mass (kg),

Sk=Conveyance mass (kg),

Nl=the Net load (kg);

at least one passive balance rope having a first end, a second end, and a mass per meter, wherein said at least one passive balance rope is suspended below said conveyance by the first end of said at least one passive balance rope and suspended below said counterweight by the second end of said at least one passive balance rope; and the mass per meter of said at least one passive balance rope is smaller than the mass per meter of said at least one head rope, the mass per meter of said at least one passive balance rope is approximately:

$$q2=(z1*q1*H-0.5*Nl)/(z2*H)$$

where:

q1=the mass per meter of said at least one head rope (kg/m), q2=the mass per meter of said at least one passive balance rope (kg/m), z1=number of said at least one head rope, z2=number of said at least one passive balance rope, H=the hoisting distance (m), the hoisting distance being greater than 1400 meters.

4. The device according to claim 3, wherein the hoisting distance is greater than 1500 meters.

5. Method of making an underground transport system comprising the steps of:

providing a driving pulley;

selecting a head rope to pass over said driving pulley;

providing a conveyance connected to a first end of said head rope;

providing a counterweight connected to a second end of said head rope;

selecting a balance rope to hang from said conveyance and said counterweight, said balance rope connected to said conveyance at a first end of said balance rope and said balance rope connected to said counterweight at a second end of said balance rope;

said balance rope having a mass per meter that is smaller than a mass per meter of said head rope, the mass per meter of said balance rope determined employing the following equation:

$$q2=(z1*q1*H-0.5*Nl)/(z2*H);\ \text{and}$$

where:

q1=the mass per meter of said at least one head rope (kg/m), q2=the mass per meter of said at least one passive balance rope (kg/m), z1=number of said at least one head rope, z2=number of said at least one passive balance rope, H=the hoisting distance (m), the hoisting distance being greater than 1400 meters, Nl=net load of the conveyance (kg).

6. A hoisting device for underground transport comprising:

a driving pulley for providing a driving force, said driving pulley having a first side and a second side;

at least one head rope with a mass per meter suspended from said driving pulley, said head rope having a first end suspended from the first side of said driving pulley and a second end suspended from the second side of said driving pulley, a conveyance for transporting a net load over a hoisting distance, said conveyance attached to the first end of said head rope;

a counterweight attached to the second end of said head rope, said counterweight having a weight of about:

$$Mv=Sk+0.5*Nl$$

where:

Mv=Counterweight mass (kg),

Sk=Conveyance mass (kg),

Nl=the Net load (kg);

at least one passive balance rope having a first end, a second end, and a mass per meter, wherein said passive balance rope is suspended below said conveyance by the first end of said passive balance rope and said passive balance rope is suspended below said counterweight by the second end of said balance rope; and wherein the mass per meter of said passive balance rope is smaller than the mass per meter of said head rope to partly compensate for a difference in suspended head rope length between the first side of said driving pulley and the second side of said driving pulley, the mass per meter of said passive balance rope is approximately:

$$q2=(z1*q1*H-0.5*Nl)/(z2*H)$$

where:

q1=the mass per meter of said at least one head rope (kg/m), q2=the mass per meter of said at least one passive balance rope (kg/m), z1=number of said at least one head rope, z2=number of said at least one passive balance rope, H=the hoisting distance (m), the hoisting distance being greater than 1400 meters.

7. The device according to claim 6, wherein the hoisting distance is greater than 1500 meters.

* * * * *